US005203122A

United States Patent [19]

Campbell

[11] Patent Number: 5,203,122

[45] Date of Patent: Apr. 20, 1993

[54] METHOD OF GRINDING TITANIUM

[75] Inventor: James D. Campbell, Cromwell, Conn.

[73] Assignee: United Technologies Corporation, Hartford, Conn.

[21] Appl. No.: 894,404

[22] Filed: Jun. 5, 1992

[51] Int. Cl.[5] ..... B24B 1/00

[52] U.S. Cl. ..... 51/322; 51/281 R

[58] Field of Search ..... 51/281 R, 322, 165.77, 51/165.73

[56] References Cited

FOREIGN PATENT DOCUMENTS 610512 12/1960 Canada ..... 51/281

OTHER PUBLICATIONS

Blake, K. R., "The Development of High Velocity Carbide Grinding", Tooling and Production, Nov. 1954.

Tarasov, Leo, "How to Grind Titanium", American Machinist, pp. 135–146, Nov. 10, 1952.

RMI Titanium, RMI Company, Niles Ohio.

*Primary Examiner*—Bruce M. Kisliuk

*Assistant Examiner*—Bo Bounkong

*Attorney, Agent, or Firm*—Charles E. Sohl

[57] ABSTRACT

This invention relates to the grinding of titanium alloys and particularly to the grinding of titanium alloys using electroplated synthetic diamond wheels with surface speeds in excess of 2290 surface meters per minute. Other operating parameters are defined which permit the effective grinding of titanium at high rates and which produce desirable residual surface compressive stresses in the surface of the ground article.

2 Claims, 1 Drawing Sheet

METHOD OF GRINDING TITANIUM

TECHNICAL FIELD

This invention relates to methods for grinding titanium alloys at high speeds using electroplated diamond grinding wheels.

BACKGROUND ART

Grinding is a well known machining technique which is widely used with many materials. However, grinding of titanium has long been a difficult task which is rarely accomplished with the necessary efficiency and the desired ground surface properties.

Titanium is strong but not particularly hard, it is tough, it conducts heat poorly and it is quite chemically reactive. This combination of properties makes grinding difficult. While harder, less tough materials easily form discrete chips, the combination of high toughness and chemical reactivity in titanium leads to "loading" of the grinding wheel with the removed titanium. When the wheel becomes fully loaded or contaminated with titanium, the grinding process essentially ceases and what continues is metal to metal friction with smearing of the workpiece and possible titanium combustion. The smearing process is exaggerated because the low thermal conductivity of titanium causes the grinding wheel/titanium interaction point to reach a high temperature where the titanium becomes relatively soft and even more reactive.

To counteract these problems it has generally been taught in the art to use slow grinding wheel speeds and/or low metal removal rates. This minimizes the buildup of titanium on the grinding surface however, it leads to greatly reduced efficiencies.

Various technical and journal articles suggest that it is fairly conventional in the art to use grinding wheel surface speeds ranging from about 18 to about 92 meters per second (1100–5500 surface meters per minute) in combination with cut depths on the order of 0.025 mm. The journal articles deal mainly with vitrified wheels which have low thermal conductivities and are therefor prone to heat buildup.

The teachings in the technical journals lead to painfully slow removal rates.

Another important aspect of grinding metals is the condition of the resultant ground surface. Mechanical machining processes invariably produce a surface having residual stresses. Such stresses can be compressive or tensile. Tensile stresses are highly deleterious to fatigue life while compressive stresses can improve the fatigue life over that which would be obtained if the surface was stress free.

Surface microstructure is important since the presence of an alpha phase surface layer (alpha case) or a deformed surface microstructure is detrimental to the mechanical properties of the ground article. Surface microstructure problems can result from overheating during grinding.

DISCLOSURE OF INVENTION

According to the invention, single layer plated synthetic diamond grinding wheels are used to machine titanium surfaces. Surface speeds of from about 2290 to about 4000 meters per minute are employed in combination with surprisingly aggressive depths of cut and workpiece velocity. For example, according to the invention process titanium can be ground using an electroplated synthetic diamond grinding wheel with a surface speed of 3,050 meters per minute, a depth of cut of about 2.5 mm, and a relative velocity between the workpiece and the grinding wheel of about 3 mm per second. This is a remarkably aggressive metal removal schedule when contrasted with that employed in the prior art, and uniquely for such an aggressive procedure the resultant ground surface has a useful degree of residual compressive stresses and exhibits a desirable surface microstructure.

The invention grinding process is accompanied by injection of coolant both where the grinding wheel first contacts the workpiece and where the grinding wheel and the workpiece part company. The inlet coolant stream is particularly important and it is injected under conditions of pressure and nozzle design so that the coolant has a velocity which is matched fairly closely with that of the grinding wheel.

Certain coolants are preferably employed and certain forms of diamond have been found to produce optimum results.

It is an object of the invention to describe an efficient process for grinding titanium.

It is another object of the invention to describe a process which uses single layer plated diamond grinding wheels.

It is yet another object of the invention to describe a grinding process which leaves beneficial compressive residual surface stresses.

The foregoing and other objects, features and advantages of the present invention will become more apparent in light of the following detailed description of exemplary embodiments thereof as illustrated in the accompanying drawings.

BEST MODE FOR CARRYING OUT THE INVENTION

Figure 1:
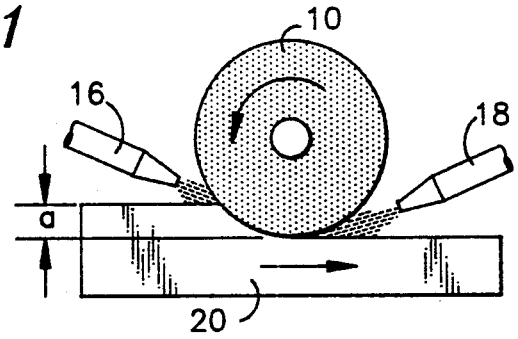
FIG. 1 shows a schematic of a grinding process.

FIG. 1 illustrates a generalized grinding setup and will be used to illustrate and describe the present invention. According to FIG. 1, grinding wheel 10 rotates in a counterclockwise fashion to grind workpiece 20. The wheel has a depth of cut "a" to remove a thickness of material "a" from the workpiece. Workpiece 20 translates relative to the grinding wheel. In most circumstances the grinding wheel will remain fixed in space while rotating and the workpiece will move relative to the wheel, but other arrangements can be used. Wheel 10 is shown as rotating down into the workpiece at the point of initial contact between the workpiece and the wheel. This is the preferred mode (called down grinding), but the wheel can rotate in the opposite sense, relative to the workpiece, with only about a 10% reduction in process efficiency.

Coolant nozzle 16 is located to inject coolant at the point of initial contact between the wheel and the workpiece, while nozzle 18 injects coolant at the point where the wheel and the workpiece separate. These nozzles are fed from pressurized filtered sources of coolant/lubricant which are conventional and not shown. An important feature of the invention process is that the coolant emitted from nozzle 16 into the initial contact point between the workpiece and the wheel is matched in speed to the peripheral speed of the wheel so that the relative speed between the coolant and the wheel is very slight. In practice we prefer to match the speed of the coolant to the speed of the wheel to within about ±10%. Both nozzles 16 and 18 extend across the entire cutting face of the grinding wheel 10. In our example grinding process using a 152 mm diameter wheel having a 6.4 mm width rotating at 7,000 rpm to produce a surface speed of about 55 surface meters per second, coolant was injected at a pressure between 21 and 28 kilograms per square cm across the full width of the wheel at a rate of 30 liters per minute, or 120 liters per minute per cm of wheel width. A reasonable range would be 30 to 75 liters per minute per cm of wheel width. The coolant injected into the exit area of the wheel is at a much lower pressure and rate and its primary purpose is to cool the wheel and the workpiece, and quench sparks. In our tests we used a pressure of about 2 kilograms per square cm and 7.6 to 11.4 liters per minute for a 6.35 mm wide wheel, or about 15 liters per minute per cm of wheel width. A reasonable range would be 9 to 23 liters per cm of wheel width per minute.

There are many types of coolant used in machining and many types of coolant used in grinding. We have found that two types of coolant produce satisfactory results and are required for the practice of the present invention.

The first type of suitable coolant is an oil base material containing an EP (extreme pressure) additive. It can be alternatively described as containing 70–98% severely hydrotreated petroleum oils and 2% to 20% chlorinated paraffin. This material is available from Castrol Inc. and Luscon Industries under the trade names of Van Straaten 5456-A and Luscon 9202, respectively. Preferably the viscosity of this material falls in the range of 50–70 S.U.S. (Seybolt Universal Seconds) at 100° F.

The second type of coolant used is that it is a synthetic soluble oil which is added in an amount of from about 3% to 30% by volume to a water base. An alternate description is that this material is a synthetic emulsible grinding compound which forms a stable milky-white microemulsion. A suitable synthetic soluble oil is available from Quaker Chemical Corp. under the trade name of Microcut 541-PW. Nonsynthetic soluble oils have been evaluated without good success.

The oil base coolant apparently provides better lubrication but the water base material provides better cooling. The coolant effect is important because the synthetic diamond cutting material employed in the practice of the invention has a critical decomposition temperature of about 940° C.

The invention process uses a metal matrix grinding wheel containing a single layer of diamond abrasive. I have used wheels made by electroplating techniques but believe that single layer metal bonded wheels made by other techniques such as the so called brazing process would be equally useful. Metal matrix grinding media provide substantial benefits in heat removal and allow higher wheel velocities in titanium grinding than do other types of abrasive wheels. Diamond is the required abrasive, other types of abrasive such as cubic boron nitride have been evaluated without success. Diamond abrasive is available in various forms which may be either natural or synthetic. Synthetic diamonds are preferred because of their uniformity and, in particular the type of synthetic diamond abrasive known in the trade as MBG type is most preferred. MBG is an industry designation for a type of single crystal diamond abrasive especially suited for grinding. It is available from the General Electric Corporation. Diamond particle sizes ranging from 30 to 325 mesh (U.S. Standard Sieve) may be used, particle sizes of from 80 to 200 mesh are preferred. My experimental work used 100% dense electroplated wheels from the Norton Co. of Worcester, Mass., sold under the trade name Amplex.

There are three types of commercial titanium alloys: those that are primarily alpha phase, those that are primarily beta phase, and those that are mixtures of the alpha and beta phases. The present invention was evaluated with a common commercial alpha-beta type alloy (Ti-4Al-4V). Extensive prior experimentation and technical treatises have shown that grinding parameters are generally quite similar between the three types of alloys.

Figure 2:
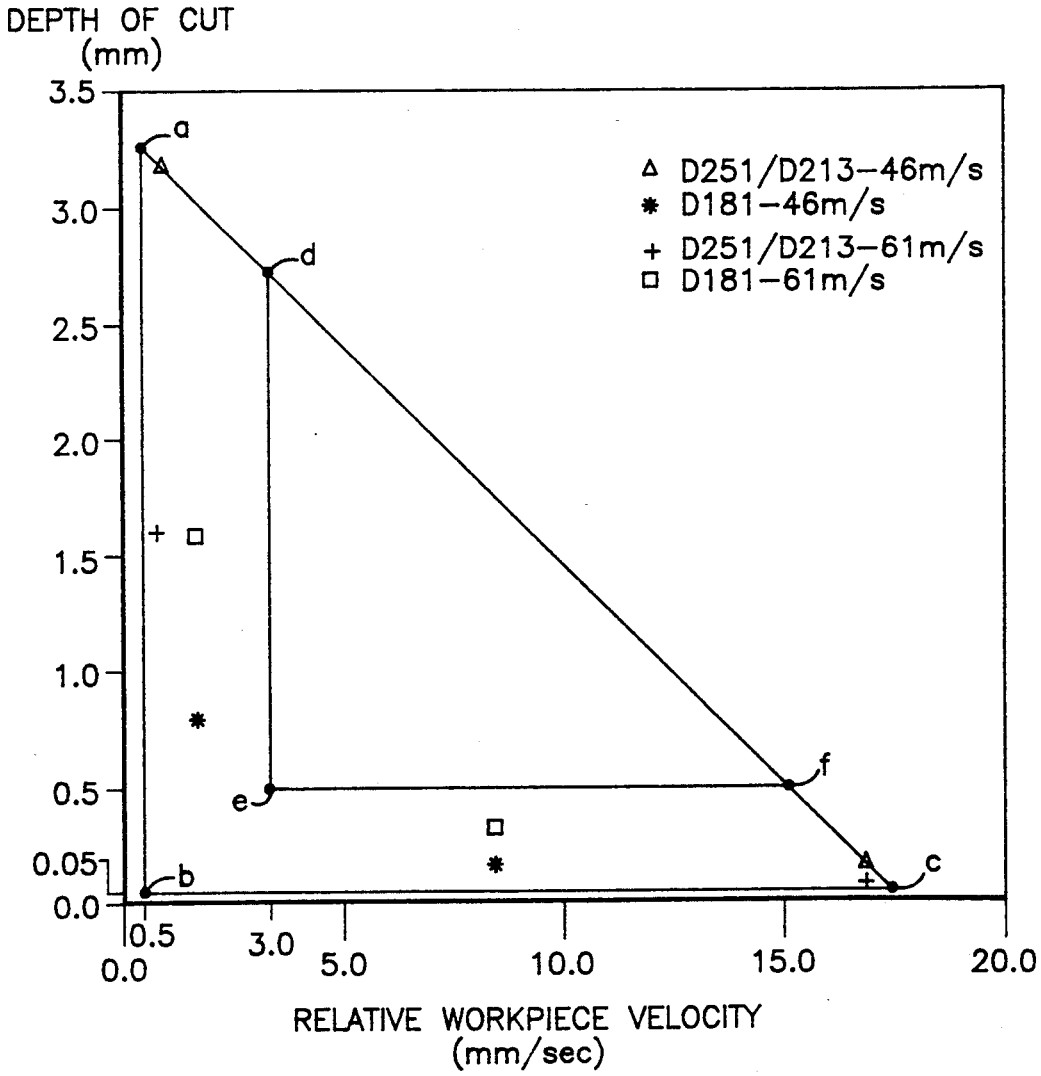
FIG. 2 shows combinations of depth of cut and relative workpiece velocity useful with the present motion.

FIG. 2 illustrates the relationship between some essential parameters of the present invention. In FIG. 2 the Y axis shows the depth of cut, while the X axis shows the speed of the workpiece relative to the wheel. The broad definition of the invention is conditions lying within the points a, b, and c but preferably the operating parameters lie within the points d, e, f and wherein the line connecting points a and c is defined by $Y=-0.1875\times+3.28$. Operating conditions above the line connecting points a and c tend to produce poor surface finishes and possibly residual tensile stresses. Consideration of FIG. 2 and comparison of the information of FIG. 2 with the previously mentioned technical references shows that the present invention has the capability to provide greatly enhanced rates of removal of titanium.

EXAMPLE

The Taguchi L8 orthogonal array design of experiment matrix shown in Table 1 was used for this test. Two levels of each of the independent variables were used. The tests were run in the order given in the matrix. The test pieces were AMS 4928 (Ti-6Al-4V) bar stock, which were mill annealed, and had an average hardness of 32 $R_c$. They had dimensions of 82 mm ×19 mm ×15 mm and the slots were cut in a single pass across the 19 mm dimension. $v_w$ (wheel velocity relative to the workpiece) for each test was held constant at 12.7 mm per minute and the down mode of grinding was used throughout this experiment. $V_s$ designates the wheel surface speed.

TABLE 1

Design of Experiment Matrix

| Test No | Fluid Type | $v_s$[1] (m/s) | U.S. Std Sieve Grit Size | a[2] (mm) |
|---|---|---|---|---|
| 1 | Oil | 48 | 80/100 | 3.175 |
| 2 | Oil | 48 | 80/100 | 6.350 |
| 3 | Oil | 58 | 200/230 | 3.175 |
| 4 | Oil | 58 | 200/230 | 6.350 |
| 5 | Water-Soluble | 48 | 200/230 | 3.175 |
| 6 | Water-Soluble | 48 | 200/230 | 6.350 |
| 7 | Water-Soluble | 58 | 80/100 | 3.175 |
| 8 | Water-Soluble | 58 | 80/100 | 6.350 |

[1] = Grinding wheel surface speed.
[2] = Depth of cut.

The straight oil used in this test was the previously described Luscon 9202 and contained 50% fat, 2.5% total sulfur, 0.7% active sulfur, and 40% chlorine in a petroleum and had a viscosity of 50 SUS to 60 SUS, whereas the water-soluble fluid was the previously referenced Microcut 541-PW in a 5% concentration. It contains 2 amino-2-methyl-1 -propanol, hexahydro-1,3,5-tris (2 hydroxyethyl) S-triazine, T-polyehoxy amine and Alkenyl carboxylic acid/Akanolamine salt. A silicon anti-foaming agent was added to the water-soluble fluid to keep the level of foam to a minimum. The temperature of both fluids was held at 36° C.±1.5° C. for all tests. A high pressure nozzle, with a rectangular cross section to match the wheel shape, was used at the entrance of the cut. A low pressure flood nozzle was positioned at the exit of the cut.

MBG synthetic diamond abrasive grit on a plated 152 mm diameter, 6.35 mm wide grinding wheel was used.

EQUIPMENT

Superabrasive Machining center with high frequency spindle, temperature controlled coolant and mist collector.

Digital data acquisition system.

Piezoelectric force dynamometer.

RESULTS

Based on results of the tests that were run, an equation was generated to relate the factors to the various responses, or independent variables, of interest (i.e., residual stress). The regression coefficients and equation used was:

$$\sigma = 168 + 10.7(\pm 1) - 0.022(v_s) + 0.37(\text{grit size}) + 5.60(\text{i a})$$

Table 3 contains statistics needed to determine the significance of the independent factors on the dependent variables (residual stress). The R-square value shows the ability of the independent variables to account for the variation in the dependent variables. The PR>F value indicates the percent confidence $\{(1.0-PR>F)\times 100\}$ that the model, used to predict the dependent variables, is correct. The magnitude of the sum of the squares (Σ Sq) shows which independent variable is the most significant with regard to a particular dependent variable. Larger values of the sum of the square indicates more significance.

TABLE 3

| Dependent Variable | Statistics for Dependent Variable | | | | | |
|---|---|---|---|---|---|---|
| | $R^2$ | PR>F | Fluid Type Σ Sq | $v_s$ Σ Sq | Grit Size Σ Sq | a Σ Sq |
| $\sigma$ | 0.9998 | 0.0001 | 912 | 3898 | 3898 | 0.98 |

Table 3 is interpreted as meaning that the mathematical model accounts for 99.98% of the variation in residual stress with 99.99% confidence. The relatively large, identical sum of squares values associated with abrasive size and $v_s$ indicated that those independent variables are equally the most significant factors contributing to residual stress. Fluid type is the next most significant factor, depth of cut is least important and in fact is not statistically significant.

Table 4 lists the mean values of the dependent variables. The mean values indicate which level of the independent variables is the better of the two, i.e., produces less tensile or more compressive residual stresses. MSD is the value of the minimum significant difference between the mean values.

TABLE 4

| Independent Variable | Stress Response MSD | Level | $\sigma$ |
|---|---|---|---|
| Fluid Type | 1.84 | $H_2O$ | 0 |
| | | Oil | −21 |
| $v_s$ | 1.84 | 48 | 11 |
| | | 58 | −32 |
| Grit Size | 1.84 | D76 | 11 |
| | | D181 | −32 |
| a depth of cut | 1.84 | 6.350 | −10 |
| | | 3.175 | −11 |

Table 4 shows that the absolute value of the differences of mean residual stress values for the two levels of fluid type, $v_s$ and grit size were greater than the MSD and were therefore statistically significant. The depth of cut is not significant. Straight oil, the higher level of $v_s$ (58 m/s) and coarse abrasive size produced higher mean values of compressive residual stress, and are therefore desired. This use of a "−" prefix indicates a compressive residual stress.

None of the photomicrographs of the samples ground in this experiment revealed any worked layer or oxygen-rich layer, such as $\alpha$ case. The grinding temperatures evidently were below the $\beta$ transus.

EXAMPLE 2

The example is similar in several respects to Example 1. The same equipment was employed. The coolant/lubricant used was the previously described oil base material containing 5.0% fat, 2.5% total sulfur, 0.7% active sulfur, and 4.0% chlorine. The same electro-plated diamond wheels were used and the test samples were of the same alpha-beta titanium material. The primary different aspect of the example is that different grinding conditions were employed (pendulum and creep grinding). The test conditions are shown in Table A.

TABLE A

| Test No | Mode | $v_w$ (mm/min) | Grit Size U.S. Standard Sieve | $v_s$ (m/s) | a (mm) | No Passes |
|---|---|---|---|---|---|---|
| 1 | F | 1016 | 60/70 | 46 | 0.16 | 20 |
| 2 | S | 51 | 60/70 | 46 | 3.18 | 1 |
| 3 | F | 1016 | 60/70 | 61 | 0.08 | 40 |
| 4 | S | 51 | 60/70 | 61 | 1.59 | 2 |
| 5 | F | 508 | 80/100 | 46 | 0.16 | 20 |
| 6 | S | 102 | 80/100 | 46 | 0.79 | 4 |
| 7 | F | 508 | 80/100 | 61 | 0.32 | 10 |
| 8 | S | 102 | 80/100 | 61 | 1.59 | 2 |

The residual stresses in the resultant ground surfaces were measured by x-ray diffraction, both parallel and perpendicular to the direction of workpiece motion.

TABLE B

| No | Parallel | Perpendicular |
|---|---|---|
| 1 | −19 | −30 |
| 2 | −12 | −12 |
| 3 | −13 | −31 |
| 4 | −3 | −15 |
| 5 | −15 | −32 |
| 6 | 0 | −9 |
| 7 | −14 | −32 |
| 8 | 0 | −14 |

These results were analyzed to determine their statistical significant with the following results.

The following equation was developed to relate the independent variables to the measured residual stresses:

$$\sigma\perp = 31.813 - 13.563 \cdot A + 1.563 \cdot B - 0.0625 \cdot C - 1.438 \cdot D + 0.186 \cdot E$$

$$\sigma\parallel = 12.000 - 10.250 \cdot A - 1.125 \cdot C - 1.625 \cdot D - 0.625 \cdot D + 1.000 \cdot E$$

A sum of squares of the data yielded the following results:

TABLE C

| Independent Variable | Type III Sum of Squares Parallel ($R^2$ = 0.9248 PR > F = 0.0001) | Perpendicular ($R^2$ = 0.9248 PR > F = 0.0001) |
|---|---|---|
| Mode | 316.3 | 665.3 |
| Grit Size | 43.7 | 14.7 |
| $v_s$ | 5.4 | 36.0 |

With regard to residual stress in the longitudinal direction (i.e., parallel to the direction of the cut), from Table C it can be seen that the mathematical model can account for 92.00% of the variation with 99.99% confidence. This means that the independent variables chosen for this experiment were the correct ones and "noise" or interactions in the system are at relatively low levels. Type III Sum of Squares is used because the array used for the design of experiment only allowed for two levels of five independent variables, while v had four level of feed rate, forcing that column to be treated as if it had missing data. The way the test pieces were ground, that is the fast or slow mode, was the most significant parameter, as evidenced by its large sum of the squares variation contribution. The remaining variables in descending order of significance are grit size and $v_s$.

Table C also shows that the model can account for 94.00% of the variation in residual stress in the transverse direction (i.e., across or perpendicular to the direction of the wheel) with 99.99% confidence. As with the longitudinal stress, the most important variable was the mode in which the pieces were ground. The order of the remaining variables are $v_s$ and grit size.

The examples show that the use of high speed metal bonded single layer diamond grinding wheels on titanium with certain controlled conditions can provide useful residual compressive stresses.

It should be understood that the invention is not limited to the particular embodiments shown and described herein, but that various changes and modifications may be made without departing from the spirit and scope of this novel concept as defined by the following claims.

We claim:

1. Method of grinding a titanium workpiece including the steps of:

a. using an electroplated single layer grinding wheel;

b. rotating the electroplated grinding wheel to produce a surface speed of 38–66 m per second;

c. causing the wheel to interact with the workpiece to cause a depth of cut of at least 0.05 mm;

d. causing relative velocity between the grinding wheel and the workpiece of at least 0.5 mm per second with the combination of wheel surface speed, depth of cut and relative velocity between the wheel and workpiece resulting in an amount of material removed per pass;

e. coordinating grinding condition such that the depth of cut and relative workpiece velocity fall within an area bounded by line $Y \leqq -0.1875 \times +3.28$;

f. providing a lubricant/coolant selected from a group consisting of hydrotreated petroleum containing chlorinated paraffin and synthetic soluble oil-water emulsions.

2. Method as in claim 1 wherein the depth of cut is at least 0.5 mm and the rate of relative workpiece velocity is at least 3.0 mm per second wherein values for the depth of cut and relative workpiece velocity fall within an area bounded by line $Y \leqq -0.1875 \times +3.28$.

* * * * *